US006523272B1

(12) United States Patent
Morales

(10) Patent No.: US 6,523,272 B1
(45) Date of Patent: Feb. 25, 2003

(54) MEASURING DEVICE AND METHOD OF MANUFACTURE

(76) Inventor: George B. Morales, 1685 E. Junction, Apache Junction, AZ (US) 85219

( * ) Notice: Subject to any disclaimer, the term of this patent is extended or adjusted under 35 U.S.C. 154(b) by 0 days.

(21) Appl. No.: 09/923,267

(22) Filed: Aug. 3, 2001

(51) Int. Cl.[7] ..... B43L 13/02

(52) U.S. Cl. ..... 33/526; 33/42; 33/DIG. 20

(58) Field of Search ..... 33/32.1, 32.2, 33/42, 526, 527, DIG. 20; 29/408, 412, 416; 72/379.2

(56) References Cited

U.S. PATENT DOCUMENTS

| | | | | | |
|---|---|---|---|---|---|
| 1,619,091 | A | * | 3/1927 | Rieser | 33/DIG. 20 |
| 2,144,697 | A | * | 1/1939 | Zangrando | 33/42 |
| 3,499,308 | A | * | 3/1970 | Ford | 72/379.2 |
| 3,548,505 | A | * | 12/1970 | Di Candilo | 33/527 |
| 3,611,579 | A | * | 10/1971 | Reid | 33/32.2 |
| 3,643,335 | A | * | 2/1972 | Smith | 33/42 |
| 3,718,980 | A | * | 3/1973 | Poulos | 33/526 |
| 4,930,221 | A | * | 6/1990 | Taylor | 33/42 |
| 5,205,045 | A | | 4/1993 | Liu | 33/DIG. 20 |
| 5,361,508 | A | | 11/1994 | Ruggiero | 33/527 |
| 5,471,758 | A | * | 12/1995 | White, Sr. | 33/527 |
| 5,701,680 | A | | 12/1997 | Garcia et al. | 33/526 |
| 5,737,844 | A | | 4/1998 | Brumley | 33/42 |
| 6,112,424 | A | | 9/2000 | Friend | 33/527 |
| 6,195,904 | B1 | | 3/2001 | Greer | 33/527 |
| 6,269,672 | B1 | * | 8/2001 | Schutz | 72/379.2 |

* cited by examiner

*Primary Examiner*—G. Bradley Bennett
(74) *Attorney, Agent, or Firm*—Parsons & Goltry; Robert A. Parsons; Michael W. Goltry

(57) ABSTRACT

An adjustable measuring device includes a base having a front end, a rear setting end, opposing sides and a slidably attached slide member having a front marking end, a rear end and opposing sides. A pair of opposing locking elements is attached at the front end of the base for releasably securing the sides of the slide member against the base. One of the locking elements is attached to one of the sides of the base at the front end thereof and the other of the locking elements is attached to the other of the sides of the base at the front end thereof.

17 Claims, 3 Drawing Sheets

FIG. 2
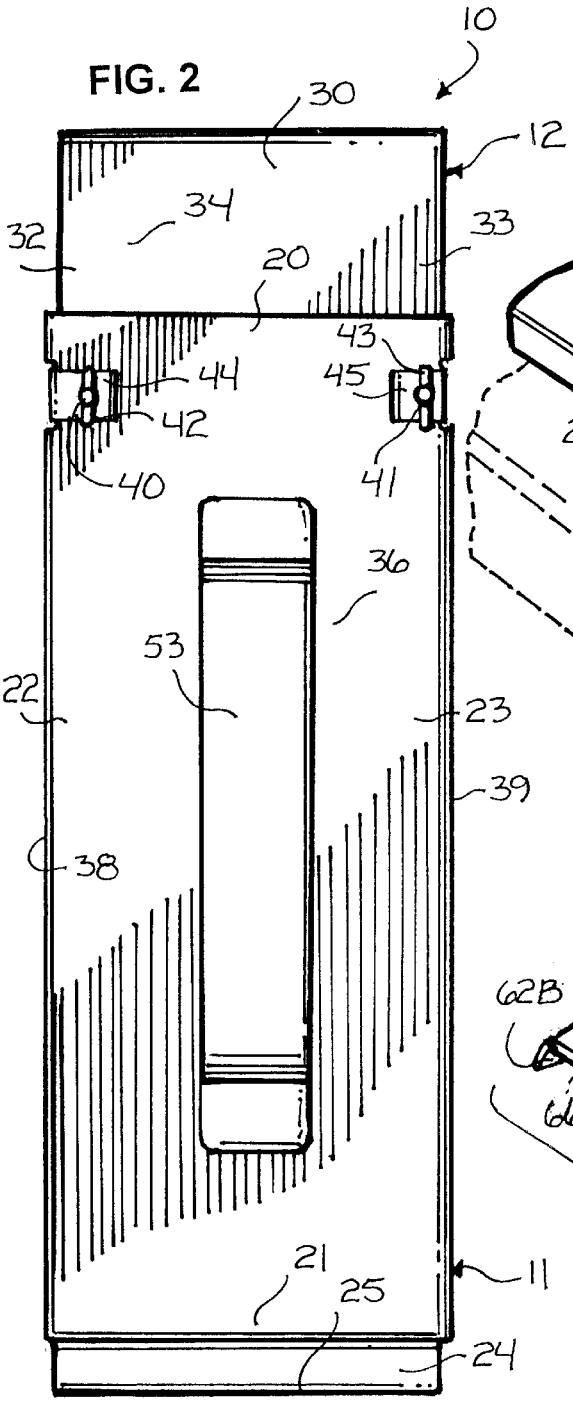
FIG. 4
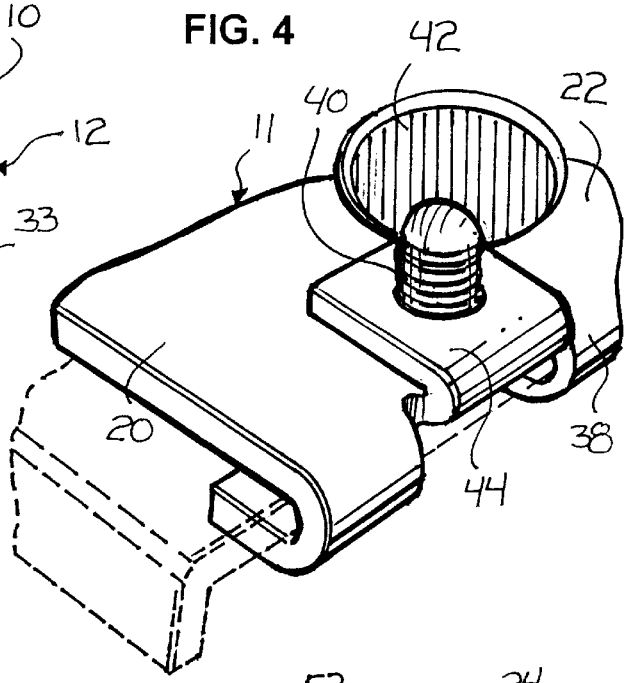
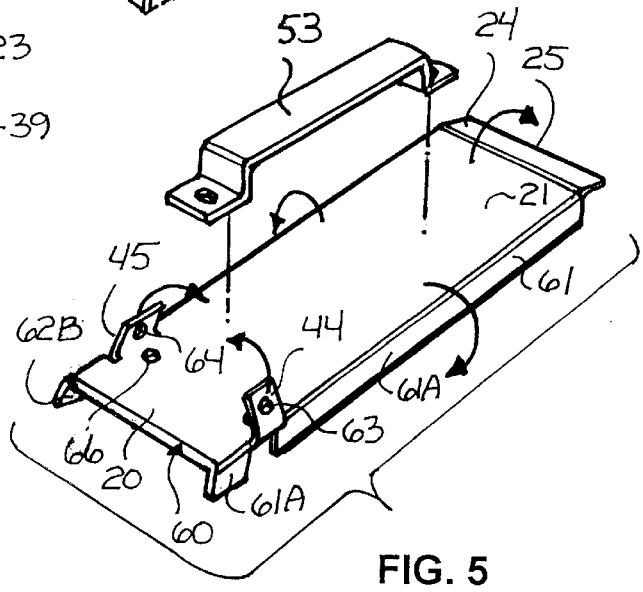
FIG. 5

MEASURING DEVICE AND METHOD OF MANUFACTURE

FIELD OF THE INVENTION

This invention relates to tile installation techniques and methods and, more particularly, to tile measuring devices and to methods of manufacturing tile measuring devices.

BACKGROUND OF THE INVENTION

The use of ceramic and clay floor tiles is well known. In a typical tile installation, tiles are bonded to a subfloor or other prepared surface with an adhesive such as thin set mortar. Tiles are commonly laid in place with a small, uniform gap existing between adjacent tiles. These gaps are filled with grout.

One task that must be routinely executed when laying rectangular or square tile is cutting tiles which are to be laid about the perimeter of a given space such that the cut tile is suitably sized for installation between the last laid full size tile and a marginal straight edge, such as a wall. The common practice of accomplishing this is to cut perimeter tiles to fit the remaining space between the last laid tile and the wall using a tape measure while accounting for grout joint spacing on each side of the perimeter tile. This method is time consuming and requires precise alignment of the loose tile to permit it to be scribed and cut accurately. If the tile is not properly positioned, aligned, or cut, then the tile will not properly fit the available space. The problem is even more pronounced when the tile setter does not possess the skill of a professional.

In response to the problems associated with the foregoing method of measuring and cutting tile, tile measuring tools are now available. Many of the existing tile measuring tools are adjustable and provide an easy way for skilled and unskilled workers to cut and piece in tile pieces between a marginal edge and a last laid full size tile. Although most existing tile measuring tools are adequate, they are difficult to adjust and manufacture. Given these and other deficiencies in the art, the need for certain new and useful improvements in the field of tile measuring devices is evident.

SUMMARY OF THE INVENTION

The above problems and others are at least partially solved and the above purposes and others realized in an improved adjustable measuring device and method of manufacture. Preferably, an adjustable measuring device of the invention includes a base having a front end, a rear setting end, opposing sides and a slidably attached slide member having a front marking end, a rear end and opposing sides. A locking element is attached to one of the sides of the base at the front end thereof for releasably securing one of the sides of the slide member against the base. Another locking element is attached to the other of the sides of the base at the front end thereof for releasably securing the other of the sides of the slide member against the base. Preferably, the locking elements are threadably attached to the sides of the base in working opposition to the sides of the slide member. The sides of the slide member are slidably received in opposing ways disposed at the sides of the base. The locking elements are considered disposed at and attached to the ways of the base.

The invention also contemplates a method of manufacturing a measuring device. In accordance with the principles of the invention, a preferred method includes steps of a)providing a first piece of malleable sheet stock having a front end, a rear end, opposing first and second sides and opposing first and second major faces, and b)forming a first tab into the first side of the first piece at the front end thereof and an opposing second tab into the second side of the first piece at the front end thereof. The method further includes steps of c)folding the first and second tabs over the first major face of the first piece, and d)folding lengths of the sides of the first piece over the second major face of the first piece so as to form opposing ways. The method next provides e)providing a second piece of sheet stock having a front end, a rear end and opposing sides, f)slidably disposing the opposing sides of the second piece into the opposing ways of the first piece, g)attaching a first locking element to the first tab and to an opposing portion of the first piece in working opposition to one of the sides of the second piece, and h)attaching a second locking element to the second tab and to an opposing portion of the first piece in working opposition to the other of the sides of the second piece. Preferably, the step of attaching the first locking element to the first tab and to the opposing portion of the first piece in working opposition to one of the sides of the second piece further includes the step of threadably attaching the first locking element to the first tab and to the opposing portion of the first piece in working opposition to the one of the sides of the second piece. The step of attaching the second locking element to the second tab and to the opposing portion of the first piece in working opposition to the other of the sides of the second piece further includes the step of threadably attaching the second locking element to the second tab and to the opposing portion of the first piece in working opposition to the other of the sides of the second piece. The invention also provides a measuring device constructed in accordance with the foregoing method.

BRIEF DESCRIPTION OF THE DRAWINGS

Referring to the drawings:

FIG. 2 is a top plan of the measuring device of FIG. 1;

FIG. 4 is an enlarged fragmented perspective view of a portion of the device of FIG. 1 illustrating a locking element;

FIG. 5 is an elevated perspective of the base of FIG. 1 and a handle as they would appear during the assembly of the measuring device of FIG. 1;

DETAILED DESCRIPTION OF A PREFERRED EMBODIMENT

The present invention provides new and improved apparatus for measuring tile and associated methods of manufacturing a measuring device. In the interest of clarity, the ensuing discussing sets forth the structural features of a measuring device in §A, and a method of manufacturing a measuring device in §B.

§A. Apparatus

Figure 1:
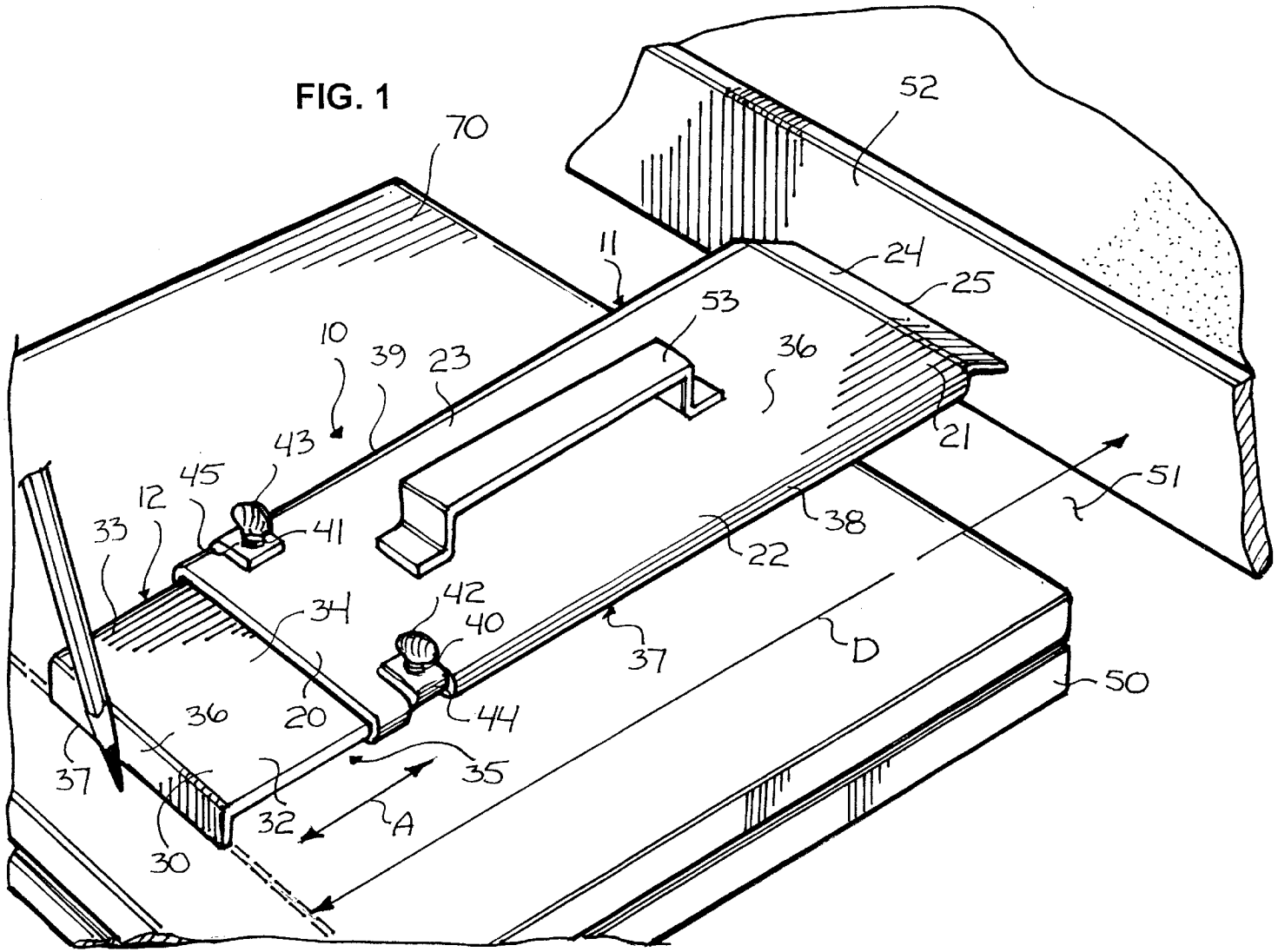
FIG. 1 is an isometric view of a measuring device in use during the installation of a floor tile and constructed and arranged in accordance with the invention, the measuring device including a base and a slidably attached slide member.
Figure 3:
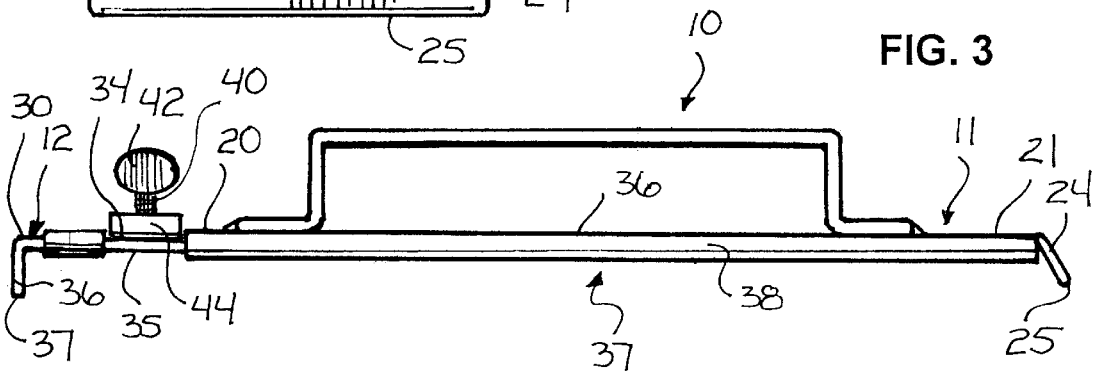
FIG. 3 is a side elevation of the measuring device of FIG. 1, the opposite side elevation being the substantial mirror image.

Referring to the drawings, FIGS. 1–3 illustrate a measuring device 10 embodying the principles of the invention.

FIG. 1 illustrates device 10 in use during tile installation. Device 10 includes a base 11 and an attached reciprocally movable slide member 12. Preferably, base 11 and slide member 12 are each constructed of malleable sheet stock such as steel, aluminum or the like. However, base 11 and slide member 12 can be fashioned from plastic or wood or other form of generally rigid material or combination of materials. Preferably, base 11 and slide member 12 are each integrally fashioned from a single piece of malleable sheet stock. However, base 11 and slide member 12 can each be assembled from two or more prefabricated parts. Base 11 and slide member 12 are generally coextensive.

As further seen in FIGS. 1 and 2, base 11 is overall generally planar and rectangular and has a front end 20, a rear end 21 and opposing sides 22,23. Rear end 21 is considered a setting end of device 10 and is characterized by a down-turned portion 24 having a free edge 25. Edge is considered a setting edge and defines a setting end of device 10. Down-turned portion 24 and free edge 25 are also well illustrated in FIG. 3. With continuing reference to FIG. 1, base 11 also includes opposing major faces 36,37 and ways 38,39. Ways 38,39 are formed at sides 22,23, respectively, extend along substantially the entire length of base 11 from front end 20 to rear end 21, and are characterized by elongate side portions that are in-turned toward major face 37.

As still further seen in FIGS. 1 and 2, slide member 12 is overall generally planar and rectangular and has a front end 30, a rear end 31 (shown only in FIG. 7), opposing sides 32,33 and opposing major faces 34,35 (face 35 is denoted in FIGS. 1,3). Front end 30 is considered a marking end of device 10 and is characterized, as shown in FIGS. 1,3, by a down-turned portion 36 having a free edge 37. Edge 37 is considered a marking edge and defines a marking end of device 10.

Regarding FIGS. 1,2, sides 32,33 of slide member are located in ways 38,39, respectively, and are slidably received therein. Rear end 31 of slide member 12 extends into front end 20 of base 11 and front end 30 of slide member 12 extends away from front end 20 of base 11. Consistent with this arrangement, slide member 12 is movable in reciprocal directions in opposition to front end 20 of base 11 as generally indicated by the double arrowed line A in FIG. 1, which therefore allows the marking end of device 10 to be moved in reciprocal directions in opposition to base 11. This permits the marking end of device 10 to be moved relative to base 11 to a position that corresponds to the size of a given tile plus the grout joint spacing on each side of the perimeter tile, which is actually twice the width of the grout line. This measuring distance D as denoted in FIG. 1 is measured from the marking end of device 10, namely, free edge 37, to the setting end of device 10, namely, edge 25. Distance D as measured from edge 25 to edge 37 set with the aid of a tape measure or ruler or other appropriate measuring device. Attached locking elements 40,41 are useful for locking slide member 12 in place to base 11 after the slide member 12 is adjusted and distance D from edge 25 to edge 37 is set.

Locking elements 40,41 are adjustably attached to base in working opposition to sides 32,33 of slide member 12 and are thus capable of interacting with sides 32,33 and locking them against ways 38,39, respectively. Preferably, locking element 40 is attached to side 22 at front end 20 of base 11. Locking element 41 opposes locking element 40 and is attached to side 23 at front end 20 of base 11. Locking element 40 is a threaded element that extends through base 11 and into way 38 and opposes side 32 of slide member 12 and is movable in reciprocal directions in opposition to side 32 in response to rotation thereof. Locking element 41 is also a threaded element that extends through base 11 and into way 39 and opposes side 33 of slide member 12 and is movable in reciprocal directions in opposition to side 33 in response to rotation thereof. By selectively rotating locking elements 40,41, they can be loosened for permitting the reciprocal adjustment of slide member 12 relative to base 11 and tightened against sides 32,33 of slide member 12 for securing sides 32,32 against ways 38,39, respectively, for securing slide member 12 against base 11. Locking elements 40 and 41 are furnished with enlargements 42,43, respectively, for easy gripping.

Base 11 includes tags 44,45 that are located at sides 22,23, respectively, at front end 20. Tags 44,45 overly and oppose respective portions of face 36. Looking also to FIG. 4, locking element 40 is threadably attached to and received by tag 44 and to the opposing portion of base 11 that it overlies and extends into way 38 in opposition to side 32. Consistent with this structural arrangement, locking element 40 can be considered attached to way 38. Locking element 41 is threadably attached to and received by tag 45 and to the opposing portion of base 11 that it overlies and extends into way 39 in opposition to side 33. Consistent with this structural arrangement, locking element 41 can be considered attached to way 39.

FIG. 1 illustrates a tile 50 laid with a space 51 left between it and a wall 52, which can be considered a marginal edge of an enclosure. To cut a piece of tile to fit in space 51, it is only necessary to adjust the distance between edges 37 and 25 of device to correspond to the width of tile 50 plus twice the width of the grout line, lay a second tile 70 on top of tile 50, place edge 25 against wall 52, position edge 37 atop tile 70 and then draw a line along tile 70 where indicated by edge 37, with that portion of tile 70 forward of the drawn line to define the tile piece to be cut away and fit into space 51. A handle 53 attached to face 36 by welding or rivets or the like is useful for wielding device 10 during use.

Tiles are often laid in a diamond form. However, it is only necessary to extend the distance between edges 37 and 25 to the diagonal dimension of the tile plus twice the width of the grout line and then to use device 10 exactly as before to make a portion of the tile to be cut.

The use of device 10 is reversible, such that edge 37 can be employed as the setting edge and edge 25 the marking edge. Device 10 is disclosed herein as useful in connection with tile, and it may also be used with stone, marble, wood flooring, vinyl flooring, etc.

§B. Method of Manufacture

Figure 6:
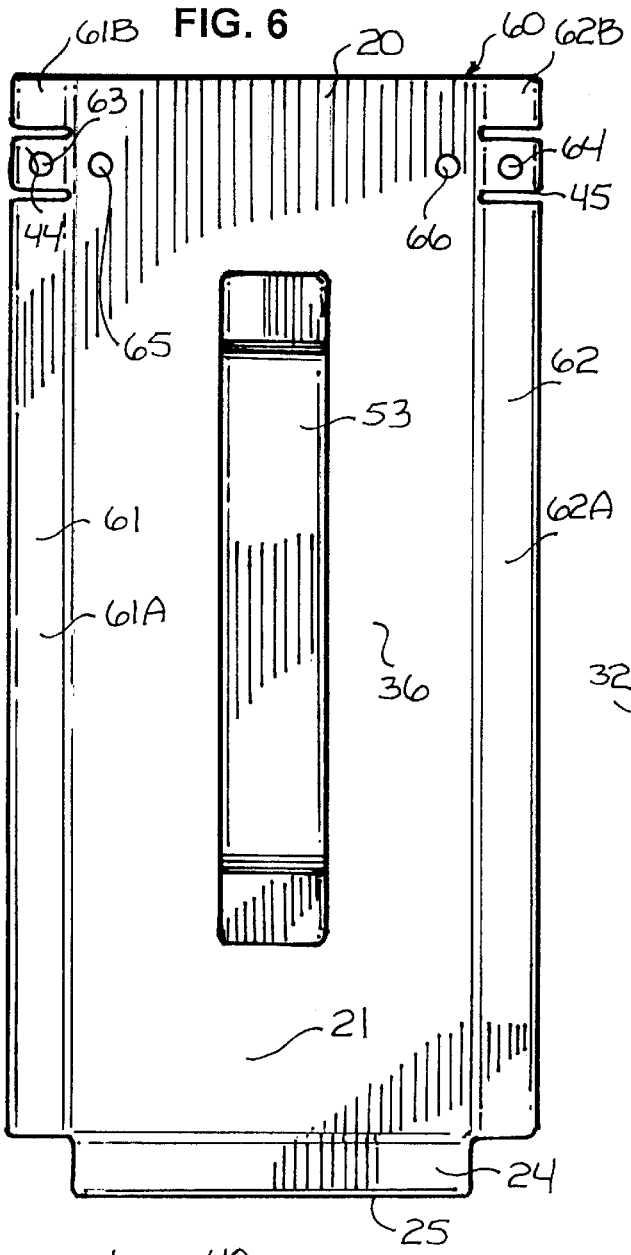
FIG. 6 is a top plan of a piece of sheet material fashioned during the formation of the base of FIG. 1.

In accordance with the principles of the invention, it is preferred that base 11 and slide member 12 be integrally formed from malleable sheet stock such as steel, aluminum or the like and preferably steel. Consistent with this, attention is now directed to FIG. 6, in which is shown a top plan of a generally flat or planar piece 60 of malleable sheet material. Piece 60 is generally rectangular and is to be formed into base 11 of device 10. Preferably, the form of piece 60 in FIG. 6 is fashioned from a larger piece of material by cutting, machining or stamping, and includes in common with base 11 front end 20, rear end 21, portion 24, free edge 25, opposing faces 36,37 (face 37 is not delineated in FIG. 6) and tabs 44 and 45. Piece 60 has opposing sides 61,62 and tabs 44,45 are formed into sides 61,62, respectively, at front end 20. In the anticipation of the threaded attachment of locking elements 40,41, holes 63,64 are formed through tabs 40,41, respectively. An adjacent, substantially equally sized hole 65 is formed through base 11 opposite to hole 63, and an adjacent, substantially equally sized hole 66 is formed through base 11 opposite to hole 64. At this point, tabs 44,45 are taken up by hand or with a gripping tool and folded over as suggested in FIG. 5 so as to overly portions of face 36 and holes 65,66, respectively, as best shown in FIGS. 1 and 2. When folded over face 36, holes 62,65 align with one another and holes 63,66 align with one another. Holes 62–66 are formed by drilling, and can be formed after tabs 44,45 are folded over if desired.

In continuing with the formation of base 11, opposing lengths 61A,62A of sides 61,62 from tabs 44,45 to rear end 21 are folded over face 37 (not shown in FIG. 6) as suggested in FIG. 5 (side 62 and length 62A is not explicitly shown in FIG. 5), which forms ways 38,39 of device 10 as best illustrated in FIGS. 1 and 2. The relatively small lengths 61A,62A of sides 61,62 from tabs 44,45 to front end 20 are also folded over in common to lengths 61A,62A and this completes the formation of ways 38,39, which generally define sides 32,33 of base 11. Lengths 61A,62A can be furnished as tabs in lieu of tabs 44,45 if desired. To complete the formation of base 11, portion 24 is folded downwardly away from face 36 as suggested in FIG. 5 and the ends of handle 53 are attached to face 36 with the use of welding, screws, rivets, etc.

Figure 7:
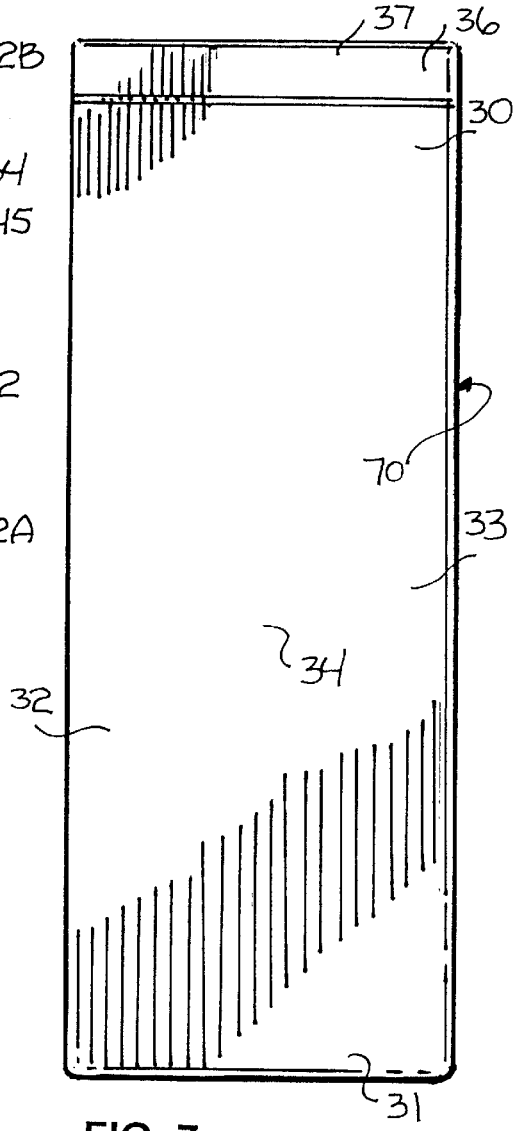
FIG. 7 is a top plan of a piece of sheet material fashioned during the formation of the slide member of FIG. 1.

Having formed base 11, slide member 12 is to be formed, although it may be formed before or during the formation of base 11. Attention is now directed to FIG. 7, in which is shown a top plan of a generally flat or planar piece 70 of malleable sheet material. Piece 70 is generally rectangular. Preferably, piece 60 is fashioned from a larger piece of material by cutting, machining or stamping, and includes in common with base slide member 11 front end 30, rear end 31, sides 32,33, faces 34,35 (face 35 is not shown in FIG. 7), portion 36 and edge 37. Portion 36 defines a length of end 30 from side 32 to side 33, and it is bent downwardly toward face 35 (not shown) or otherwise away from face 34 in the form as depicted in FIGS. 1 and 3. The width of piece 70 from side 32 to side 33 approximates the width from way 38 to way 39.

Having completed the formation of slide member 11, it is slidably inserted into base 11. This simple operation of slidably mounting slide member 12 to base 11 consists of directing rear end 31 toward front end 20 of base, locating sides 32,33 of slide member 11 at rear end 31 into ways 38,39, respectively, of base 11 at front end 20 and then forcibly sliding slide member 11 into and through ways. It is important that face 34 of slide member oppose face 37 of base 11, so that portion 36 of slide member 11 and portion 24 of base 11 each extend downwardly away from handle 53 as shown in FIG. 3. After locking element 40 is threadably installed into and through openings 63,65 in a direction from face 36 of base 11 and locking element 41 is threadably installed into and through openings 64,66 in a direction from face 36 of base 11, device 10 can then be employed in accordance with this the discussion set forth in §A, supra. It will be understood that openings 63,65 lead to way 38, that openings 64,66 lead to way 39 and that locking elements 40,41 pass into ways 38,39, respectively, and are capable of being tightened against sides 32,33, respectively, of slide member 12 for securing sides 32,33 against ways 38,39, respectively. Accordingly, it will further be understood that locking element 40 is attached to base 11 in working opposition to side 32 and that locking element 41 is attached to base 11 in working opposition to side 33.

The integral fashioning of base 11 and slide member 12 each from a single piece of malleable sheet stock are done with simple cutting and bending operations and so the manufacture of a measuring device in accordance with the method of the present invention is very easy to carry out and efficient.

The present invention has been described above with reference to a preferred embodiment. However, those skilled in the art will recognize that changes and modifications may be made in the described embodiments without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. Apparatus comprising:

a base having a front end, a rear setting end, opposing sides, a first tab overlying a first portion of the base at one of the sides of the base, a second tab overlying a second portion of the base at the other of the sides of the base, and a slidably attached slide member having a front marking end, a rear end and opposing sides;

a first locking element secured to the first tab and the first portion of the base for movement between a first position away from one of the sides of the slide member and a second position against the one of the sides of the slide member securing the one of the sides of the slide member against the base; and a second locking element secured to the second tab and the second portion of the base for movement between a first position away from the other of the sides of the slide member and a second position against the other of the sides of the slide member securing the other of the sides of the slide member against the base.

2. Apparatus of claim 1, wherein the first locking element comprises a first threadably attached adjustment element disposed in working opposition to the one of the sides of the slide member.

3. Apparatus of claim 1, wherein the second locking element comprises a second threadably attached adjustment element disposed in working opposition to the other of the sides of the slide member.

4. Apparatus of claim 1, wherein sides of the slide member are slidably received in opposing ways disposed at the sides of the base.

5. Apparatus of claim 4, wherein base includes opposing major faces and the ways are disposed at one of the major faces.

6. Apparatus comprising:

a base having a front end, a rear setting end, opposing sides each forming a way, a first tab overlying a first portion of the base at one of the sides of the base, and a second tab overlying a second portion of the base at the other of the sides of the base;

a slide member having a front marking end, a rear end and opposing sides each slidably disposed in one of the ways;

a first locking element secured to the first tab and the first portion of the base for movement between a first position away from one of the sides of the slide member and a second position against the one of the sides of the slide member securing the one of the sides of the slide member against the one of the ways; and a second locking element secured to the second tab and the second portion of the base for movement between a first position away from the other of the sides of the slide member and a second position against the other of the sides of the slide member securing the other of the sides of the slide member against the other of the ways.

7. Apparatus of claim 6, wherein the first locking element comprises a first threadably attached adjustment element disposed in working opposition to the one of the sides of the slide member.

8. Apparatus of claim 6, wherein the second locking element comprises a second threadably attached adjustment element disposed in working opposition to the other of the sides of the slide member.

9. Apparatus of claim 6, wherein base includes opposing major faces and the ways are disposed at one of the major faces.

10. A method comprising steps of:

providing a first piece of malleable sheet stock having a front end, a rear end, opposing first and second sides and opposing first and second major faces;

forming a first tab into the first side of the first piece at the front end thereof and an opposing second tab into the second side of the first piece at the front end thereof;

folding the first and second tabs over the first major face of the first piece;

folding lengths of the sides of the first piece over the second major face of the first piece so as to form opposing ways;

providing a second piece of sheet stock having a front end, a rear end and opposing sides;

slidably disposing the opposing sides of the second piece into the opposing ways of the first piece;

attaching a first locking element to the first tab and to an opposing portion of the first piece in working opposition to one of the sides of the second piece; and attaching a second locking element to the second tab and to an opposing portion of the first piece in working opposition to the other of the sides of the second piece.

11. The method of claim 10, wherein the step of attaching the first locking element to the first tab and to the opposing portion of the first piece in working opposition to one of the sides of the second piece further includes the step of threadably attaching the first locking element to the first tab and to the opposing portion of the first piece in working opposition to the one of the sides of the second piece.

12. The method of claim 10, wherein the step of attaching the second locking element to the second tab and to the opposing portion of the first piece in working opposition to the other of the sides of the second piece further includes the step of threadably attaching the second locking element to the second tab and to the opposing portion of the first piece in working opposition to the other of the sides of the second piece.

13. A measuring device constructed by the method of claim 10.

14. A method comprising steps of:

providing a first piece of malleable sheet stock having a front end, a rear end, opposing first and second sides and opposing first and second major faces;

folding lengths of the sides of the first piece over the second major face of the first piece so as to form opposing ways;

providing a second piece of sheet stock having a front end, a rear end and opposing sides;

slidably disposing the opposing sides of the second piece into the opposing ways of the first piece;

attaching a first locking element to the base in working opposition to one of the sides of the second piece; and attaching a second locking element to the base in working opposition to the other of the sides of the second piece.

15. The method of claim 14, wherein the step of attaching the first locking element to the base in working opposition to one of the sides of the second piece further includes steps of:

forming a first tab into the first side of the first piece at the front end thereof;

folding the first tab over the first major face of the first piece; and adjustably attaching the first locking element to the first tab and to an opposing portion of the first piece in working opposition to the one of the sides of the second piece.

16. The method of claim 14, wherein the step of attaching the second locking element to the base in working opposition to the other of the sides of the second piece further include steps of:

forming a second tab into the second side of the first piece at the front end thereof;

folding the second tab over the first major face of the first piece; and adjustably attaching the second locking element to the second tab and to an opposing portion of the first piece in working opposition to the other of the sides of the second piece.

17. A measuring device constructed by the method of claim 13.

* * * * *